US011047557B1

(12) United States Patent
McMillan

(10) Patent No.: US 11,047,557 B1
(45) Date of Patent: Jun. 29, 2021

(54) MULTI-PIGTAIL POWER MODULE FOR LIGHTING

(71) Applicant: George Erik McMillan, Hickory, NC (US)

(72) Inventor: George Erik McMillan, Hickory, NC (US)

( * ) Notice: Subject to any disclaimer, the term of this patent is extended or adjusted under 35 U.S.C. 154(b) by 0 days.

(21) Appl. No.: 17/011,937

(22) Filed: Sep. 3, 2020

Related U.S. Application Data

(60) Provisional application No. 62/895,215, filed on Sep. 3, 2019.

(51) Int. Cl.

| | |
|---|---|
| ***F21V 23/02*** | (2006.01) |
| ***F21V 23/06*** | (2006.01) |
| ***F21V 23/04*** | (2006.01) |
| ***F21V 23/00*** | (2015.01) |
| ***F21Y 115/10*** | (2016.01) |

(52) U.S. Cl.
CPC ..... *F21V 23/02* (2013.01); *F21V 23/003* (2013.01); *F21V 23/04* (2013.01); *F21V 23/06* (2013.01); *F21Y 2115/10* (2016.08)

(58) Field of Classification Search
CPC ..... F21V 23/02; F21V 23/003; F21V 23/04; F21V 23/06
USPC ..... 362/640
See application file for complete search history.

(56) References Cited

U.S. PATENT DOCUMENTS

| | | | | |
|---|---|---|---|---|
| 5,738,436 | A * | 4/1998 | Cummings | F21S 2/00 362/294 |
| 10,139,891 | B2 * | 11/2018 | Probin | G06F 1/3287 |
| 10,276,106 | B2 * | 4/2019 | Lee | G09G 3/342 |
| 2015/0257227 | A1 * | 9/2015 | Lu | H05B 47/19 315/201 |
| 2016/0135263 | A1 * | 5/2016 | Chen | F21K 9/60 315/200 R |

* cited by examiner

*Primary Examiner* — Bryon T Gyllstrom
(74) *Attorney, Agent, or Firm* — Ascentage Patent Law, LLC; Travis Lee Johnson

(57) ABSTRACT

In one aspect, a power module configured to provide power to a plurality of LED light fixtures includes a plenum-rated structure. The power module is configured to provide DC power or low voltage AC power to the LED light fixtures via a plurality of plenum-rated pigtail cables and a plurality of quick-connect connectors for each of the pigtail cables.

20 Claims, 6 Drawing Sheets

MULTI-PIGTAIL POWER MODULE FOR LIGHTING

RELATED APPLICATIONS

This application claims the benefit of U.S. Provisional Patent Application No. 62/895,215 filed on Sep. 3, 2019; which is herein incorporated by reference in entirety.

TECHNICAL FIELD

The present invention generally relates to ceiling light fixtures, and particularly relates to power modules for LED light fixtures.

BACKGROUND

Ceilings have light fixtures that require a junction box to be installed for the light fixtures. This includes the physical installation of the junction box and the electrical installation of the junction box. With drop down ceilings, the physical installation requires setting up a support bar in the plenum (space above the ceiling tiles) in order to support the junction box. The electrical installation of the junction box requires the AC line voltage wires that run from the breaker box or other power junction terminate in the junction box. The light fixture is then installed. After the light fixture for the junction box is physically installed, the electrical installation of the light fixture requires that the wires from the light fixture be terminated in the junction box.

The junction box and any wires or cables in the plenum are subject to safety codes applicable to the plenum. For example, the safety codes prohibit a junction box from having exposed sockets. Therefore, a light fixture may not simply plug into a socket on the side of a junction box in the plenum. This is because any wires with sufficient voltage or current to start a fire or shock a person must be permanently enclosed in an approved conduit.

Also, emergency lighting systems for buildings are typically costly to install and provide a very low level of light in an emergency situation. Typically, an emergency lighting system only lights a third or less of the lights in a building. Also, installing the emergency lighting system is costly as often each light that will be powered requires secondary conduit, a junction box, wiring, and a backup power supply.

SUMMARY

Physically and electrically installing a junction box for a light fixture is costly and labor intensive. The voltage in power wires also presents a shock risk. Embodiments of the present invention include a power module that can power multiple light fixtures and do so in a manner that eliminates any fire or shock risks.

In at least one embodiment, a system configured to provide a power to a plurality of light fixtures is described. The system includes a power module and a plurality of cable. The power module is connected to a main power source and has a housing or structure. The power module is configured to provide power to the plurality of light fixtures via a plurality of cables and an amount of power provided to power each of the plurality of light fixtures is lower than an amount of power received by the power module from the main power source. Each of the cables has quick-connect connector at one end and at least one of the cables terminates inside the structure of the power module on the other end.

The system may further include a control component to at least one light fixture and the output of the power module, wherein the control component is configured to control the power supplied to the at least one light fixture. The control component is powered by the power module.

In at least one embodiment, the system includes a backup power supply configured to provide power to each light fixture of the plurality of light fixtures when the power module receives no power from the main power source.

Also contemplated herein is a method of installing a lighting system. The method includes physically and electrically installing a power module configured to receive a high level current and provide a low-level current to power a plurality of light fixtures. The power module includes a plurality of plenum-rated pigtail cables, each having one end that terminates inside a plenum-rated housing of the power module and another end that terminates with a quick-connect connector. At least two light fixtures are physically installed into the ceiling. Each of the light fixtures has a plenum-rated pigtail cable having one end that terminates inside or at a structure of the light fixture and another end that terminates with a quick-connect connector. The quick-connect connectors of the at least two light fixtures are each connected to the respective quick-connect connectors of the power module.

In at least one embodiment, the method includes installing additional lights fixtures and includes connecting the quick-connect connectors of the additional light fixtures to an additional quick-connect connector of one of the at least two light fixtures. As contemplated herein is a system configured to provide power to a plurality of light fixtures. The system includes a power module, a plurality of cables, a plurality of quick-connectors, a first control unit, and a first light fixture. The power module is connected to a main power source, has a structure and at least one power output. The power module is configured to provide power to the plurality of light fixtures via a plurality of cables. Each of the cables has a quick-connector on one end at least one of the cables terminates inside the structure of the power module on the other end. The control unit is configured to control one or more light fixtures and the control unit is electrically connected to the power module via at least one cable and at least one quick-connect connector. The light fixture has a first electrical input and a first electrical output. The first light fixture is electrically connected to the control unit via at least one cable and at least one quick-connect connector and receives power at the first electrical input.

In at least one embodiment, the system includes a second light fixture having a second electrical input and a second electrical output. The second light fixture is electrically connected to the first output and receives power at the second electrical input.

In at least one embodiment, the system includes a third light fixture having a third electrical input and a third electrical output. The third light fixture is electrically connected to the second output and receives power at the third electrical input. The first control unit controls power provided to the first light fixture, the second light fixture and the third light fixture.

In at least one embodiment, the system includes a second control unit configured to control one or more light fixtures and the second control unit is electrically connected to the power module via at least one cable and at least one quick-connect connector. The system also includes a fourth light fixture having a fourth electrical input and a fourth electrical output. The fourth light fixture is electrically connected to the second control unit via at least one cable and at least one quick-connect connector and receives power at the fourth electrical input.

In at least one embodiment, the system includes a fifth light fixture having a fifth electrical input and a fifth electrical output. The fifth light fixture is electrically connected to the fourth output and receives power at the fifth electrical input.

In at least one embodiment, the power module is configured to provide an output of power at or below a regulatory threshold where additional conduit is not required for housing the plurality of cables.

An advantage of the disclosed systems and methods is that there is a large reduction in materials needed to install a lighting system and a reduction in the time it takes to install the system. The disclosed systems and methods have been able to reduce up to 80% of the materials needed to install a lighting system with an equal reduction in labor cost and time.

Of course, the present invention is not limited to the above features and advantages. Those of ordinary skill in the art will recognize additional features and advantages upon reading the following detailed description, and upon viewing the accompanying drawings.

DETAILED DESCRIPTION

Current LED lighting systems require a junction box for ceiling light fixtures. This is due to the regulations that require that all power wires be in a conduit where the power level exceeds a regulatory threshold. Embodiments of the present invention describe a power module that can be disposed in or near a junction box that powers multiple LED light fixtures and does so safely according to current safety regulations.

Figure 1:
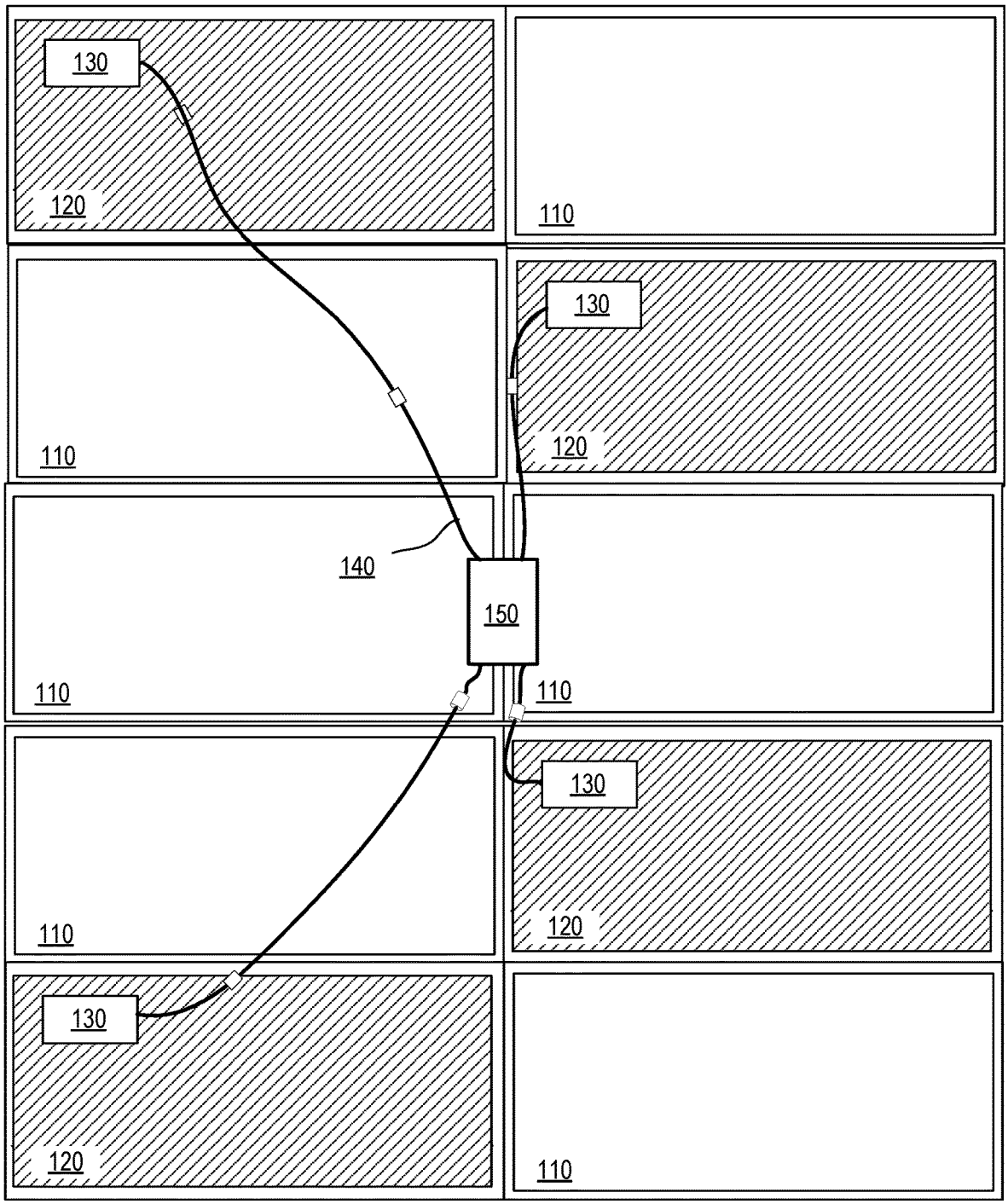
FIG. 1 is a plenum-side diagram of an LED lighting system, according to some embodiments.

FIG. 1 illustrates a diagram of an LED lighting system installed in a ceiling, according to some embodiments. The ceiling includes regular ceiling tiles 110 and LED light fixtures 120. A single power module 150 of the lighting system is installed physically and electrically. The physical support and electrical power wires to power module 150 are not shown here, but no other physical supports and power wires are necessary for other power modules for respective LED light fixtures 120 in this system. Power module 150 provides the power that drives each of LED light fixtures 120. LED light fixtures 120 may each have a receiving component 130 that receives the power from power module 150. In some cases, this may include a driver. In other cases, this only provides a termination structure for a pigtail cable of LED light fixture 120, because power module 150 provides power for all the LED light fixtures, as well as a power limiter and/or power converter, such as one that converts AC to DC.

Figure 2:
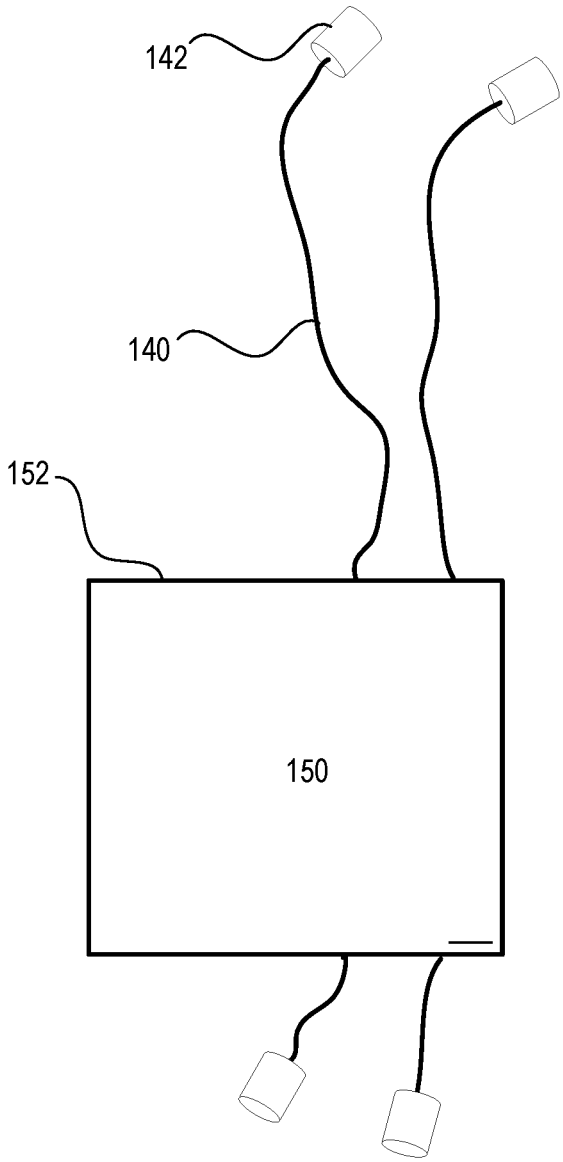
FIG. 2 is a diagram of a power module of the LED lighting system, according to some embodiments.

According to some embodiments, power module 150 is configured to provide power to LED light fixtures 120 using plenum-rated pigtail cables 140 that are terminated inside power module 150. Plenum-rated cables must have a fire-retardant plastic jacket of either a low-smoke polyvinyl chloride (PVC) or a fluorinated ethylene polymer (FEP), for example. As shown in FIG. 2, the pigtail cables are terminated on the other end with connectors 142, which may be quick-connect connectors like twist-lock or snap-in connectors.

Power module 150 includes a plenum-rated structure 152, and is configured to provide power to LED light fixtures 120 via a plurality of plenum-rated pigtail cables 140 and a plurality of quick-connect connectors 142 for each of the pigtail cables 140. Each of the pigtail cables 140 terminates inside structure 152 on one end and terminates with one of connectors 142 on the other end.

The power provided through the plenum-rated pigtail cables 140 are fire safe and shock safe. Driver 156 provides no more than the 40 W or so (less than 100 W) required by an LED light fixture, depending on the number of emitters and their power requirements. The plenum-rated cables are fire safe with no more than 60 V or 10 A (or 5 A or even 0.8 A) through pigtail cables 140. These numbers are examples and may be updated according to a local governing body and regulations as such the systems and methods are configured to limit or reduce the total Watts, amps and/or volts sent through a given cable, so as to eliminate the need for additional conduit. Thus, meeting fire safe and shock safe standards. It should also be understood that the power module 150 can have multiple plenum cables connected therefrom (as shown in FIGS. 1 and 2) and that each output or cable can be limited to the appropriate regulatory requirements.

In some embodiments, some of pigtail cables 140 of power module 150 are of different lengths (e.g., half) than other pigtail cables 140 out of the same power module 150. Pigtail cables of various lengths may be connected in between pigtail cables 140 of power module 150 and those of LED light fixtures 120.

Figure 3:
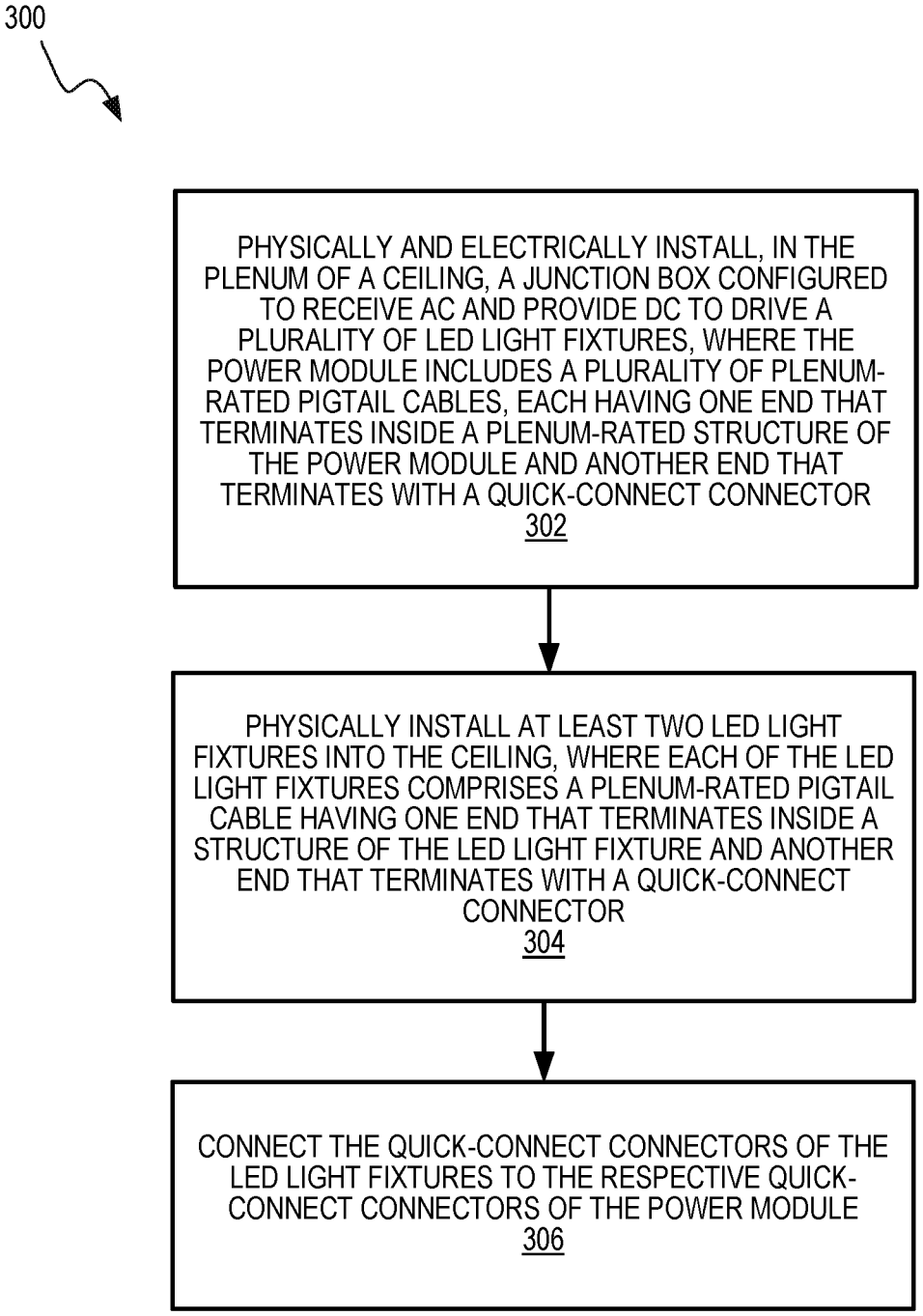
FIG. 3 illustrates a flowchart of a method of installing the LED lighting system, according to some embodiments.

The combination of the single power module for multiple LED light fixtures and the lower power and voltage of the plenum-rated pigtail cables (safely terminated inside the structure of the power module) provides for an easier and safer installation that reduces the installation costs by more than 60%. Much of the reduction in cost is attributed to using fewer junction boxes and eliminating the use of additional conduit that is currently used to house electrical cables as a result of the systems and methods described herein. Additionally, costs are reduced, because the installation labor costs are also reduced as result of a design that takes less time to implement. An example of the easier installation is given by the flowchart for method 300 in FIG. 3, according to some embodiments.

Method 300 includes physically and electrically installing, in the plenum of a ceiling, a power module configured to receive AC and provide DC to drive a plurality of LED light fixtures (block 302). The power module includes a plurality of plenum-rated pigtail cables, each having one end that terminates inside a plenum-rated structure of the power module and another end that terminates with a quick-connect connector. Method 300 also includes physically installing at least two LED light fixtures into the ceiling (block 304). Each of the LED light fixtures includes a plenum-rated pigtail cable having one end that terminates inside a housing of the LED light fixture and another end that terminates with a quick-connect connector. Method 300 further includes connecting the quick-connect connectors of the at least two LED light fixtures to the respective quick-connect connectors of the power module (block 306).

Figures 4A, 4B:
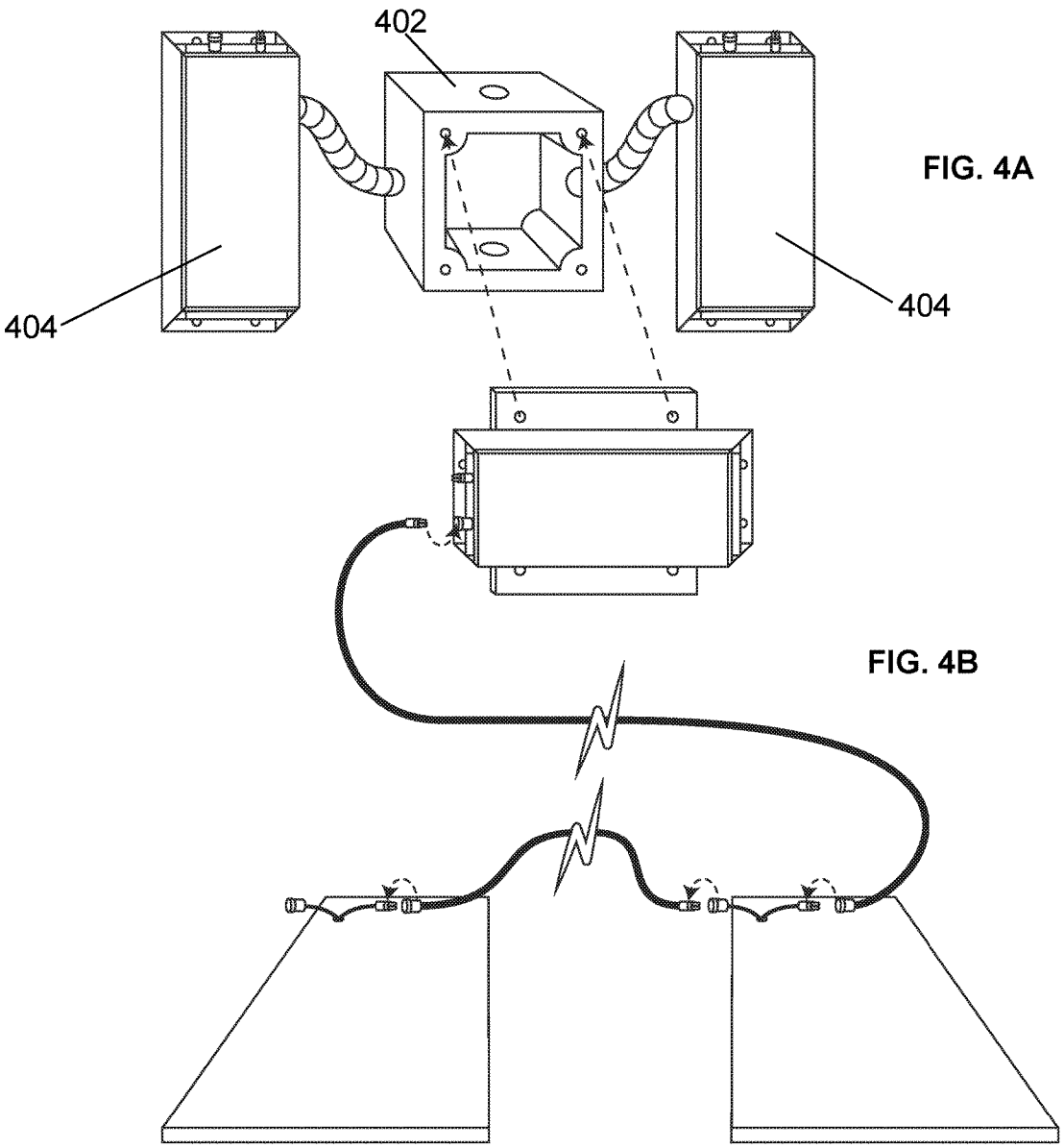
FIG. 4A is a diagram of a power module connected to multiple power sources.
FIG. 4B is a diagram of a power module mounted to the junction box and connected to a light fixture.

FIG. 4A illustrates a junction box 402 connected to two power supplies 404. The junction box is the primary junction box for the room or space in which the lighting installation system is installed. A primary low voltage power module is attached to the junction box, as shown in FIG. 4B. The power includes one or more small locking plenum approved cable or wire socket that connects to plenum approved cable or wire to provide power to one or more attached light fixtures. In one embodiment the primary low voltage power module is optimized for LED lighting and is capable of powering multiple lights. The primary low voltage power module acts as a driver or a transformer to power the light fixtures connected to the primary low voltage power module.

Figure 5A:
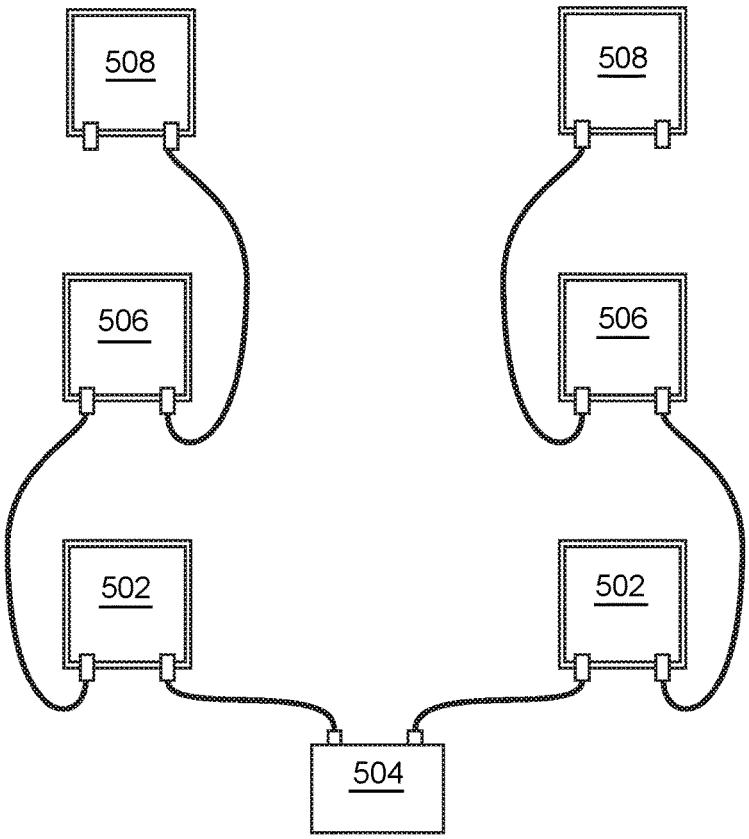
FIGS. 5A-B are diagrams of a plurality of light fixtures connected to a power module.
Figure 5B:
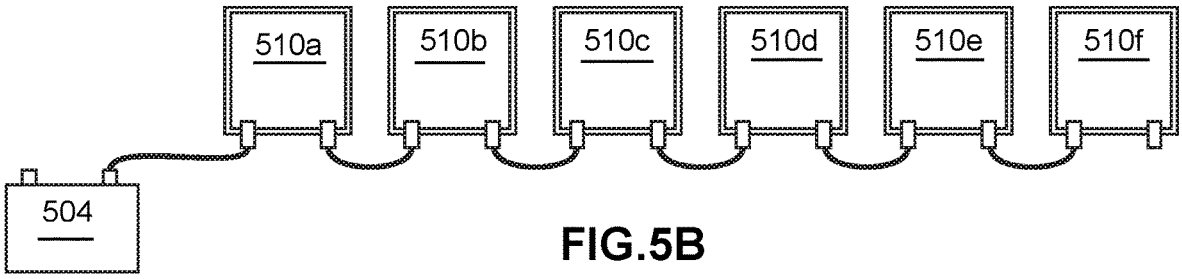

Each light fixture in the system has one or more plenum approved locking connector that connects to plenum approved cable or wire, as shown in FIGS. 5A-B. In FIG. 5A, two light fixtures 502 are connected to cable or wire that is connected to the primary low voltage power module 504 to supply power to the two light fixtures 502 in parallel. Each of these light fixtures 502 may also be connected to a second light fixture 506 via a second locking connector and cable or wire. Each of the second light fixtures 506 may be connected to a third light fixture 508 via a locking connector and cable or wire. Although each path of the light fixture chain is shown to have three lights, this is an example only and more or less lights may be included in each chain. Furthermore, one chain may have more light fixtures than the other chain.

FIG. 5B shows an example where multiple light fixtures 510*a-f* receive power from primary power module 504. In this example, only a first light fixture 510*a* is connected directly to the primary power module 504 via cable or wire that is attached to a first locking connector. The first light fixture 510*a* is then attached to a second light 510*b* fixture via cable or wire and the second light fixture 510*b* is attached to a third light fixture 510*c*. This chain may contain as few as one light fixture and as many light fixtures that the power module can support.

Although the light fixtures appear to be connected in series to the power module, each locking connector may contain a parallel connection allowing each light in the chain to be connected in parallel to the primary module. Therefore, if one of the light fixtures has malfunction or the LED "goes out" the rest of the chain will still have power and the entire chain will not stop working.

Figure 6:
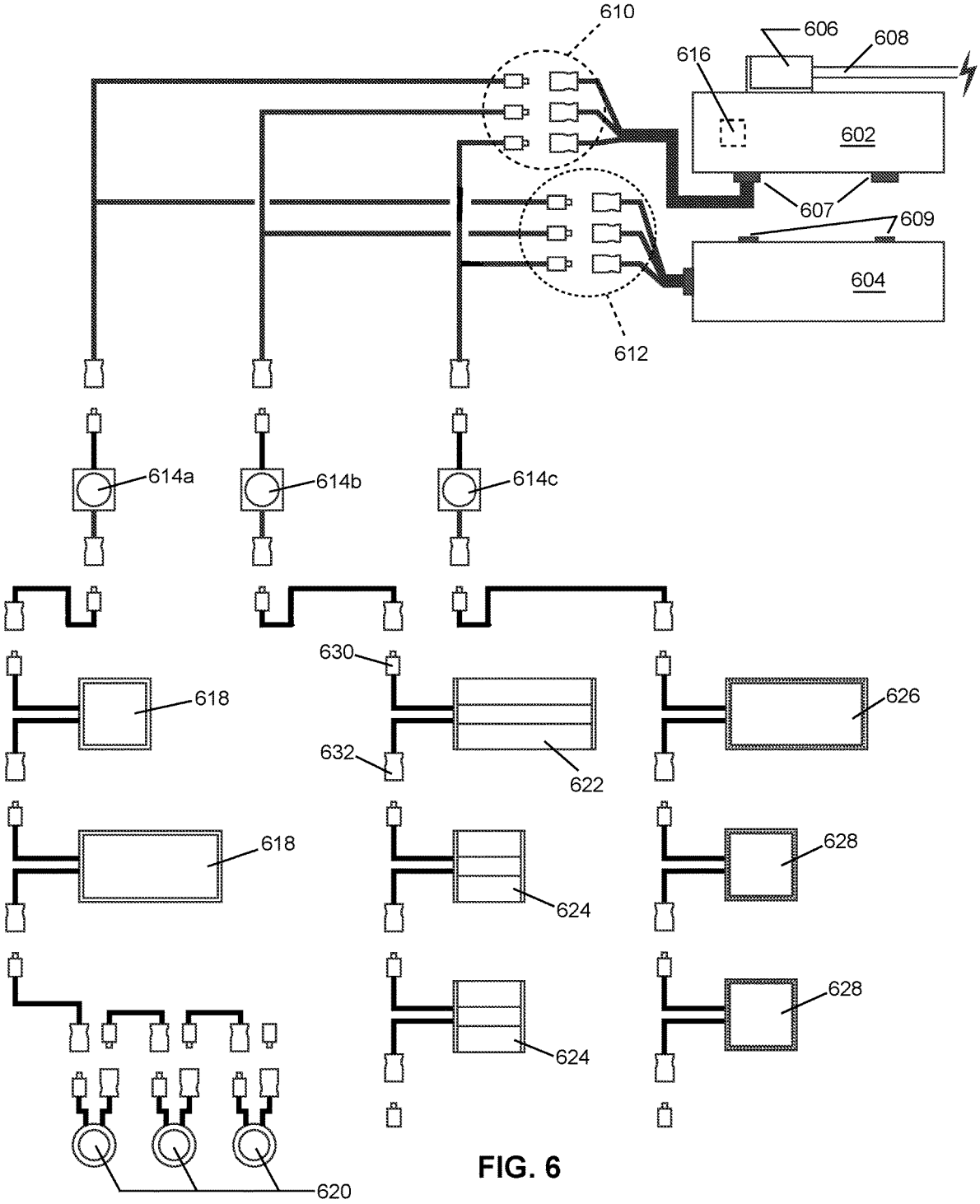
FIG. 6 is a diagram of a system for powering multiple groupings of light fixtures that are each controlled by a separate switch or control component.

FIG. 6 illustrates a plurality of groups of light fixtures connected to a power module where each group of light fixtures is controlled by a separate control component. A power module 602 is connected to a junction box 606 that is connected to a main power source via conduit 608. The output of the power module 602 is connected via cable connectors 610 and wiring to one or more control component 614*a*, 614*b*. Each of the control components 614*a-c* is connected to one or more light fixtures via wiring and electrical cable connectors. A backup power supply 604 is also connected to each control component 614*a-c* via wiring and electrical cable connectors. The power module 602 receives power from the main power source and provides a reduced level power at the power module output that is below the NEC threshold value requiring conduit. For example, the power output will be limited to approximately thirty volts and eight amps. The reduced power level allows the installer to use wiring without conduit reducing the material cost and labor cost of installing the lighting system. In one embodiment, the power module 602 includes an AC to DC convertor. In an alternative embodiment, the power module 602 does not have an AC to DC convertor and the power module 602 outputs a low level of DC.

In one embodiment, the power module 602 incudes a power limiter 616 that is utilized to limit a maximum power level that is provided at the output of the power module 602. The power module may include a power level indicator that an installer utilizes to determine the power level at the power module 602 output. In one embodiment, the power limiter 616 may be controllable by the installer, and the installer may use the power limiter to increase or decrease the power level to provide desired power level.

In at least one embodiment, the power level indicator is a visual indicator, such as a digital meter displaying the power level to the installer. In another embodiment, the power level indicator includes an induction coil, such as a current transformer (CT) induction coil, that picks up the output wattage. The installer may read the wattage on the induction coil using a hand-held watt reader. In another embodiment, the installer may use the electrical cable connectors to connect a wattage reader to the output of the power module 602. Once the maximum power level is set, the power module will never output a higher power level unless the power level is changed via the power limiter 616.

The control components 614*a-c*, are used to control one or more light fixture. The light fixtures may be more than one type of light fixture. For example, one control component 614*a* is used to control panel light fixtures 618 and downlights 620. A second control component 614*b* is used to control troffer lights 622 and 624. A third control component 614*c* is used to control frame edge lights 626 and 628. The control components 614*a-cc* may be any type of suitable light controller such as an on/off switch, a dimmer, a motion detector, an occupancy sensor, or a photosensor. The control component 614*a-c* is used to control the power to one or more light fixtures, but is limited in providing power that is no greater than the maximum power set by the power limiter 616. Each of the light fixtures, may be any type of light fixture that is desired to be used.

The control components 614*a-c* may be located in different rooms, in different parts of a large room, or along a long corridor or hallway. Accordingly, the system allows for a single power module 602 to power light fixtures in multiple rooms or very large rooms where typical light system would use multiple junction boxes. Also, a single power module 602 may be used to power a large number of light fixtures. The number of light fixtures powered by a single power module 602 is limited only by the selected maximum power output and the power rating of the light fixtures. For example, power module may be limited to output 200/240 watts, or 400/480 watts. Each control unit is 614*a-c* can be connected, via wiring and cable connectors to a light fixture which may in turn connect a second light fixture to the system. For example, control unit 614*b* is electrically connected to a first light fixture 622 having an electrical input 630 and an electrical output 632. The light fixture 622 receives power from the power module 602 via the wiring, electrical connectors, and control unit 614*b*. Because the power module 602 provides the correct power required by the light fixture 622, the light fixture does not require a driver to drive the LEDs of the light fixture. The electrical input 630 of the light fixture is electrically connected to the electrical output 632 of the light fixture via internal circuitry. The internal circuitry is configured to provide equal power to the light fixture 622 and to the electrical output 632. The electrical output 632 may be connected, via wiring and an electrical connector, to a second light fixture 624. The second light fixture may in turn be electrically connected to a third light fixture as shown in FIG. 6.

In one embodiment, the power module is set to have a limiter that will control the power output at a predetermined maximum threshold.

In one embodiment, at least one control component is a low voltage occupancy sensor. The occupancy sensor receives power directly from the power module 602 via the cable connectors and wiring that provides power to the light fixtures. In one embodiment, all of the control components and all of the light fixtures operate using the same voltage. This provides an additional advantage in that no additional wiring is needed to provide power to any of the control components or the low voltage occupancy sensor. In fact, no additional wiring beyond a standard two wire system is needed for any control components.

The backup power supply 604 may be an emergency battery backup. The backup power supply can be electrically disposed inline between the power module and the plurality of light fixtures. For example, the output port(s) 607 of power module 602 can be directly connected to input port(s) 609 of backup power supply 604. The backup power supply 604 is connected to one or more light fixtures via cable connectors 612 and wiring. The backup power supply 604 is configured to provide power to the plurality of light fixtures when the power module 602 loses power. An advantage of this system is that every light fixture that is powered by the power module 602 may be powered by the backup power supply 604 using the system electrical. This provides emergency lighting with a reduced installation costs and materials needed to install the system.

Another advantage of the present system is that system may be used to connect light fixtures in multiple rooms to a single power module. Each room will have its own power switches (on/off switches) or dimmer switches. Furthermore, large spaces such as long hallways or large rooms, can have separate power switches or dimmer switches with a single power module.

Another advantage of the present system is that each individual light fixture in the chain may be different types of light fixtures. In other words, the light fixtures, control units, such as ON/OFF switches, sensors, and dimmers disposed throughout long hallways, large rooms and/or multiple rooms can utilize the same wiring that is electrically coupled to a single power module. These light fixtures and control units for the light fixtures can vary by type, size, color, and so forth. This allows for reduced labor installation, reduced parts (such as conduit and junction boxes) and greater flexibility of combinations.

The number of light fixtures that can be connected to a single power module is limited only by the wattage of the power module and of each light fixture. In one example, the power module is rated to run at up to 240 watts, so six light fixtures that operate at 40 watts can be connected to the power module. In another example, the power module is rated to operate at 480 watts. Eight 60 watt light fixtures can be connected to the power module, twelve 40 watt fixtures, or a different number of light fixtures depending on the total wattage drawn by the light fixtures.

In one embodiment, the power module has a limiter that prevents the wattage from exceeding a maximum threshold wattage. The limiter acts to shut-off some of the light fixtures or dim some or all of the light fixtures when the wattage drawn by the light fixtures exceeds the threshold wattage.

In one embodiment, a backup power supply, such as a battery, is connected to the power module. This backup power supply is able to power a number of the lights connected to the power module and to run all of the lights at some percentage of full power.

A method of installing the power module may include determining a circuit and junction box to be used for the installation of the power module. The installer tests to ensure that power to the circuit is 'off' and test circuit to confirm. The installer mounts the power module to the junction box, inside the junction box, or near the junction box. The installer connects the power module power lines directly to the feed wires within the junction box according to NEC regulations or to the junction box output wiring. The power module output or wiring replaces the junction box wiring for providing power to the system.

Once the power module has been installed, the installer may then install lighting fixtures. In order to install a light fixture, the installer selects an area where the lighting fixture is to be placed and removes any existing ceiling tile or fixture. Using a low voltage Plenum rated cable, the installer attaches a cable to one of the outputs of the power module. The installer routes low voltage cable to the light fixture position in ceiling. The cable is installed based on requirements that may dictate the cable cannot rest on the drop ceiling tiles or T-bars and must be suspended. Place the lighting fixture towards the ceiling position chosen, connect a locking low voltage cable connector of the cable to one of the input connectors of the lighting fixture, and mount light. If an additional lighting fixture is to be installed, the installer may connect the next lighting fixture in the same method connecting to one of the remaining outputs of the power module or connecting to an available output of the already installed lighting fixture.

Another advantage of the systems and methods described herein is the power module voltage can be configured to be consistent across the control components, noted above, as well as each of the light fixtures from the output of the power module. This avoids the need to have additional power modules for the separate light fixtures and control components. In some embodiments, the power module can provide multiple outputs.

Of course, the present invention is not limited to the above features and advantages. Those of ordinary skill in the art will recognize additional features and advantages upon reading the following detailed description, and upon viewing the accompanying drawings.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A system configured to provide power to a plurality of light fixtures, the system comprising:

a power module connected to a main power source, the power module having a housing and at least one power output, wherein the power module is configured to provide power to the plurality of light fixtures via a plurality of cables, wherein an amount of power provided to power each of the plurality of light fixtures is equal to or lower than an amount of power received by the power module from the main power source;

a plurality of quick-connect connectors for the plurality of cables, wherein at least one of the cables connects to an output of the least one outputs of the power module on one end and terminates with one of the quick-connect connectors on the other end; and a control component disposed inline with at least one of the plurality of cables, and configured to control the amount of power provided by the power module to at least one light fixture, wherein each control component and each of the plurality of light fixtures operate only at the same voltage.

2. The system of claim 1, further comprising:

a control component connected to at least one light fixture and the output of the power module, wherein the control component is configured to control the power supplied to the at least one light fixture.

3. The system of claim 2, wherein the control component is at least one of an on/off switch, a dimmer switch, a photosensor, a motion detector or an occupancy sensor.

4. The system of claim 3, wherein the control component is powered by the power module.

5. The system of claim 1, further comprising:

a detachable backup power supply having internal power storage separate from the main power source and directly connected to the power module, and wherein at least one backup cable is connected inline with at least one of the plurality of cables, such that when the main power source goes out, each of the light fixtures downstream from the at least one backup cable have power provided from the internal power storage of the detachable backup power supply.

6. The system of claim 1, wherein the power module is configured to provide an output of power below a regulatory threshold, such that additional conduit or insulation surrounding the plurality of cables is not required for safety purposes.

7. The system of claim 1, wherein the power module is configured to provide an output of power below a regulatory threshold, and wherein the regulatory threshold is associated with a regulation that requires additional conduit or insulation for cables when a power level exceeds the regulatory threshold.

8. A method of installing a light-emitting device (LED) lighting system, the method comprising:

physically and electrically installing a power module configured to receive a high level power and provide a low level power to drive a plurality of LED light fixtures, wherein the power module comprises a plurality of plenum-rated pigtail cables, each having one end that terminates inside a plenum-rated housing of the power module and another end that terminates with a quick-connect connector;

physically installing at least two LED light fixtures into the ceiling, wherein each of the LED light fixtures comprises a connector for connecting to a quick-connect connector or a plenum-rated pigtail cable having one end that terminates inside or at a structure of the LED light fixture and another end that terminates with a quick-connect connector; and connecting the quick-connect connectors of the at least two LED light fixtures to the respective quick-connect connectors of the power module; and operating each of the LED light fixtures only at the same voltage.

9. The method of installing a light-emitting device (LED) lighting system of claim 8, further comprising:

physically installing a third LED fixture into the ceiling, wherein the third LED light fixture comprises a plenum-rated pigtail cable having one end that terminates inside a housing of the LED light fixture and another end that terminates with a quick-connect connector; and connecting the quick-connect connector of the third LED light fixture to an additional quick-connect connector of one of the at least two LED light fixtures.

10. A system configured to provide power to a plurality of light fixtures, the system comprising:

a power module connected to a main power source, the power module having a housing and at least one power output, wherein the power module is configured to provide power to the plurality of light fixtures via a plurality of cables, wherein an amount of power provided to power each of the plurality of light fixtures is lower than an amount of power received by the power module from the main power source;

a plurality of quick-connect connectors for each of the cables, wherein at least one of the cables connects to an output of the least one power outputs of the power module on one end and terminates with one of the quick-connect connectors on the other end;

a first control unit configured to control one or more light fixtures, wherein the control unit is electrically connected to the power module via at least one cable and at least one quick-connect connector; and a first light fixture having a first electrical input and a first electrical output, wherein the first light fixture is electrically connected to the first control unit via at least one cable and at least one quick-connect connector and receives power at the first electrical input at only the same voltage as the first control unit; and a backup power supply having internal power storage separate from the main power source and directly connected to the power module, and wherein the backup power is connected inline with at least one of the plurality of cables, such that when the main power source goes out, each of the light fixtures downstream from the backup power supply have temporary power.

11. The system of claim 10, further comprising:

a second light fixture having a second electrical input and a second electrical output, wherein the second light fixture is electrically connected to the first output and receives power at the second electrical input.

12. The system of claim 11, further comprising:

a third light fixture having a third electrical input and a third electrical output, wherein the third light fixture is electrically connected to the second output and receives power at the third electrical input.

13. The system of claim 12, wherein the control unit controls power provided to the first light fixture, the second light fixture and the third light fixture.

14. The system of claim 13, further comprising:

a second control unit configured to control one or more light fixtures, wherein the second control unit is electrically connected to the power module via at least one cable and at least one quick-connect connector; and a fourth light fixture having a fourth electrical input and a fourth electrical output, wherein the fourth light fixture is electrically connected to the second control unit via at least one cable and at least one quick-connect connector and receives power at the fourth electrical input.

15. The system of claim 14, further comprising:

a fifth light fixture having a fifth electrical input and a fifth electrical output, wherein the fifth light fixture is electrically connected to the fourth output and receives power at the fifth electrical input.

16. The system of claim 10, wherein the power module provides a lower level power than the power source.

17. The system of claim 16, wherein the power module is configured to provide an output of power below a regulatory threshold where at a power level above the regulatory threshold additional conduit is required for housing the plurality of cables.

18. The system of claim 10, wherein the first light fixture is a LED light fixture.

19. The system of claim 18, wherein the LED light fixture does not have an integral driver.

20. The system of claim 10, wherein the voltage from the output of the at least one power outputs is the same across the first control unit and the first light fixture.

* * * * *